United States Patent [19]

Nailor et al.

[11] 4,269,255

[45] May 26, 1981

[54] FIRE DAMPER FRAMES

[76] Inventors: Michael T. Nailor, 189 Old Yonge St., Willowdale, Ontario, Canada, M2P 1R2; Andrew J. Hart, 15-33 Four Winds Dr., Downsview, Ontario, Canada, M3J 1K7

[21] Appl. No.: 87,611

[22] Filed: Oct. 23, 1979

[51] Int. Cl.[3] ..... F23L 13/10

[52] U.S. Cl. ..... 160/381; 52/658; 160/1

[58] Field of Search ..... 160/381, 377, 1–5; 52/658, 657; 40/152, 155

[56] References Cited

U.S. PATENT DOCUMENTS

| | | | |
|---|---|---|---|
| 3,273,632 | 9/1966 | McCabe | 160/1 |
| 3,327,764 | 6/1967 | McCabe | 160/381 |
| 3,327,766 | 6/1967 | Kurz | 160/381 |
| 3,768,223 | 10/1973 | Kurz | 52/658 |

*Primary Examiner*—J. Karl Bell

*Attorney, Agent, or Firm*—Rogers, Bereskin & Parr

[57] ABSTRACT

The disclosure relates to one piece frames for fire dampers and the like. The frames are formed from elongate sheet metal blanks each of which is folded into a centrally open, generally rectangular form. In one embodiment, ends of the blank are secured together by a central tab on one end which extends through a T-shaped slot formed at the opposite end of the blank. In another embodiment, the blank is secured in its folded form by an angle shaped end bracket and the frame is provided with at least one corner bracket forming a gusset. The blanks have inwardly directed flanges which are formed with V-shaped notches to permit folding of the blank. In one embodiment, the notches each define an angle of less than 90° and portions of the flange on each side of the notch are overlapped when the blank is folded to provide for frictional engagement between the overlapped portions. In another embodiment, the notches each define an angle of 90° so that the edges of the flange at opposite sides of the notch come into abutting relationship when the blank is folded.

8 Claims, 7 Drawing Figures

FIG. 1
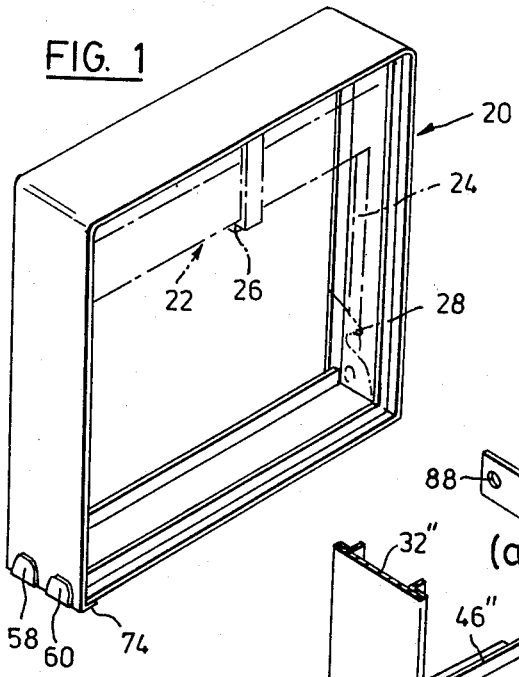
FIG. 5
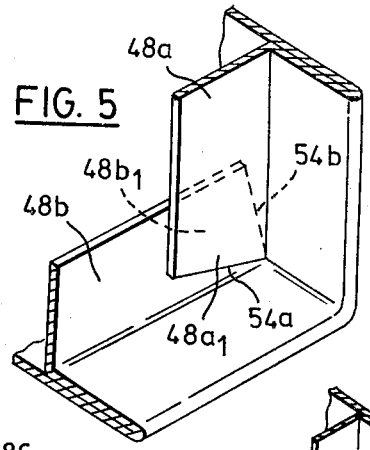
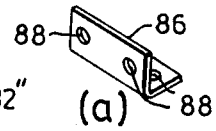
FIG 6
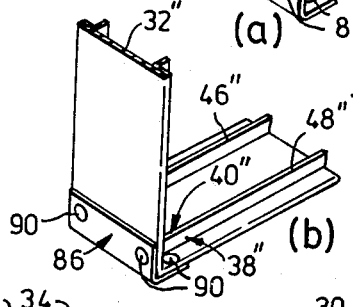
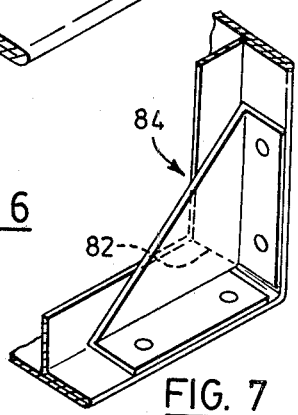
FIG. 7
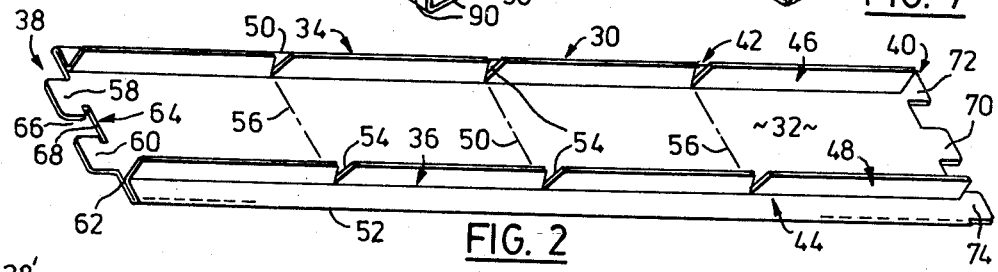
FIG. 2
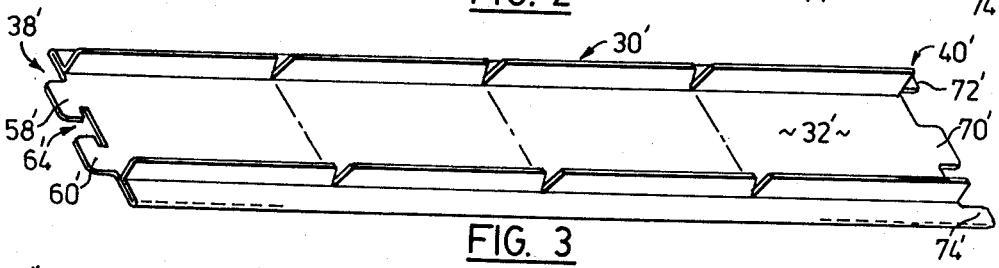
FIG. 3
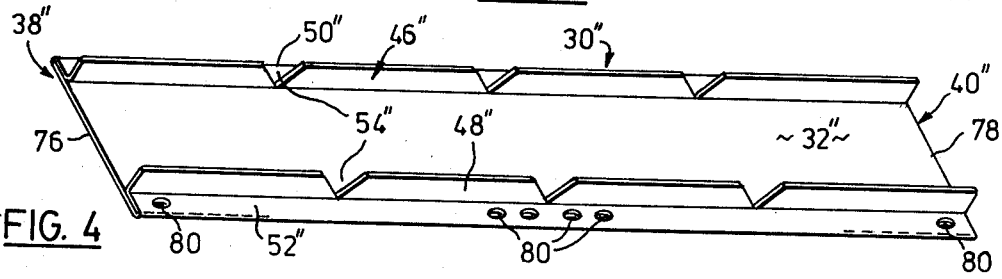
FIG. 4

FIRE DAMPER FRAMES

This invention relates to frames for fire dampers and the like.

Fire dampers are safety devices used in air ducts to arrest the flow of gases through the duct in the event of a fire. Typically, a fire damper includes a frame of centrally open, generally rectangular shape formed from a folded sheet metal blank. An assembly of interlocking blades are supported by this frame and are spring biassed to a position in which they extend across the frame to form a curtain for preventing the spread of flames and the flow of gases through the flame. The blades are normally held in a folded condition at one side of the frame against their spring biassing by a fusible link. In the event that the damper is exposed to heat, e.g. in a fire, the link will melt, releasing the blades and allowing them to move to their unfolded condition under the effect of their spring biassing.

The patent literature contains numerous examples of prior art fire dampers. One example is shown by U.S. Pat. No. 3,273,632 to Francis J. McCabe. Fire damper frames made in one piece from a folded sheet metal blank are disclosed, for example, in U.S. Pat. No. 3,327,766 and in Canadian Pat. No. 963,348, both to John C. Kurz. In both cases, the blank is folded transversely at three locations spaced longitudinally of the blank to form the four sides of the frame, and the outer ends of the blank are coupled together to close the frame.

As will be appreciated, it is important that the ends of the blank be firmly secured together and that the assembled frame be relatively rigid, not only so that the frame may be readily handled and transported prior to and during installation in a duct, but also that the frame be capable of resisting distortion in the event of fire. Thus, the extremes of temperature to which a fire damper is exposed in the event of a fire tend to cause twisting of the frame which, if not resisted, will allow leakage of gases past the interlocking blades.

In the case of the fire damper disclosed in U.S. Pat. No. 3,327,766, the ends of the folded blank are coupled together by narrow rectangular fingers which project from respective ends of the blank and which are arranged to interdigitate. After the fingers have been fitted together in this way, they are folded down, but the fingers do not interlock as such, with the result that there is a risk that the frame may tend to come apart at the corner during handling or more importantly, when the damper is exposed to extremes of temperature in use. This problem is to some extent overcome by the structure disclosed in Canadian Pat. No. 963,348, in which one end portion of the folding blank is provided with projecting fingers while the other end portion has slots for receiving the fingers. However, a problem with this design is that the formation of the slots in manufacture of the frame results in excessive wear on the tools used to form the slots. This is because relatively small dies must be used to form the slots since the slots must be quite narrow if a secure joint is to be achieved.

Prior art fire damper frames conventionally include a pair of spaced parallel flanges which extend inwardly of the frame around its inner periphery. These flanges serve to both structurally stiffen the frame and act as guides for the blades of the damper. In the blank from which the frame is formed, these flanges are formed from a pair of continuous parallel flanges extending longitudinally of the blank. The flanges must be relieved at positions corresponding to corners of the frame to permit the blank to be folded into its final rectangular form. In the case of the frame disclosed in Canadian Pat. No. 963,348, this relief is provided by slits which extend over the entire height of the relevant flange at each intended fold location. A portion of the flange adjacent to each slit is curved out of the general plane containing the remainder of the flange so that the two flange positions adjacent the slit may overlap when the frame is folded. A disadvantage of this arrangement is that formation of the curved portion of the flange requires a special operation in which a longitudinal slit is formed in the flange to permit the said portion to curve.

An object of the present invention is to provide improvements in fire damper frames aimed at overcoming the disadvantages of the prior art frames discussed above.

According to one aspect of the invention there is provided a one piece fire damper frame of centrally open, generally rectangular shape formed from a folded elongate sheet metal blank. In its unfolded form, the blank has a longitudinally extending central web portion of planar form, side edge portions, and first and second end portions. The side edge portions are longitudinally bent so as to define a pair of longitudinally extending marginal regions of double blank thickness for permitting mounting of the frame in an air duct or the like, and a pair of longitudinally extending parallel flanges disposed inwardly of said marginal regions and extending perpendicular to and disposed at the same side of the planar web portion. The flanges are divided into sections by V-shaped notches which extend over the entire height of the flange and which are intended to define corners of the completed frame, each section being aligned with the sections of the other flange transversely of the blank and extending along a side of the completed frame. The first end portion of the blank includes two similarly shaped centrally located tabs extending beyond an outer edge of the web portion and shaped so as to define therebetween an open T-shaped slot having a stem portion and a transverse portion, said transverse portion defining part of said outer edge. The second end portion of the blank includes a central tab portion shaped to fit through and fold over the transverse portion of the T-shaped slot when the frame is in its folded form and adapted to be folded over to retain the frame in said form, and outer tab portions adapted to be folded over said outer edge of the web when the frame is in its folded form. The blank is folded transversely at the positions of said notches with the flanges extending inwardly, in forming the frame.

According to another aspect of the invention there is provided a one-piece fire damper frame of centrally open, generally rectangular shape comprising a folded elongate sheet metal blank, an end bracket joining end portions of the folded blank, and at least one corner bracket disposed at a corner of the frame remote from the end bracket. The blank, in its unfolded form, includes a longitudinally extending central web portion of planar form, side edge portions, and end portions. The side edge portions are longitudinally bent so as to define a pair of longitudinally extending marginal regions of double blank thickness for permitting mounting of the frame in an air duct or the like and a pair of longitudinally extending parallel flanges disposed inwardly of the marginal regions and extending perpendicular to and disposed at the same side of the planar web. The flanges are divided into sections by V-shaped notches which extend over the entire height of the flange and which are intended to define corners of the completed frame, each section being aligned with the sections of the other flange transversely of the blank and extending along a side of the completed frame. The end portions of the blank have straight edges perpendicular to the parallel flanges and the blank is folded transversely at the positions of the notches with the flanges extending inwardly and said end portions in abutting relationship. The end bracket is of angle shape in cross-section and joins the abutting end portions of the blank, the bracket being disposed externally on said end portions and the bracket and blank including aligned holes receiving fastening means firmly securing the bracket to the blank. The corner bracket includes a gusset of right triangular shape and two flanges which project laterally from edges of the gusset adjacent its right angle at the same side of the gusset and normally thereto. The flanges of the corner bracket overlie portions of one of the marginal regions of the blank at the relevant corner of the frame and the said portions and flanges have aligned holes receiving fastening means firmly securing the corner bracket to the blank.

In order that the invention may be more clearly understood, reference will now be made to the accompanying drawings which illustrate a number of preferred embodiments of the invention by way of example, and in which:

FIG. 1 is a perspective view of an assembled fire damper frame according to a first embodiment of the invention;

FIG. 2 is a perspective view of the blank used to make the frame of FIG. 1, the blank being shown in its unfolded condition;

FIG. 3 is a view similar to FIG. 2 showing a slightly modified form of the blank of FIG. 2;

FIG. 4 is a view similar to FIG. 2 showing a blank according to a further embodiment of the invention;

FIG. 5 is an enlarged detail view of part of one corner of the frame of FIG. 1;

FIG. 6 includes two perspective views of an end bracket for use with the blank of FIG. 4, the bracket being shown individually in the view denoted (a) and in use with the blank in the view denoted (b); and, FIG. 7 is a detail view of part of the folded blank of FIG. 4 showing a corner bracket attached to the blank.

Referring first to FIG. 1, an assembled fire damper frame is generally indicated at 20. Additional components to be fitted to the frame for forming a completed fire damper are shown in ghost outline. These components include an assembly of hinged blades shown folded together in concertina fashion at the top of the frame as indicated by reference numeral 22. The blades are spring biassed downwardly by two coil springs disposed at sides of the frame, and one of which is indicated at 24, but are held in their folded condition by a fusible link 26. In the event that the fusible link melts, the coil springs will draw the blades downwardly, causing them to unfold and form a curtain closing the frame. A locking device 28 is provided for holding the blades in this condition. The components shown in ghost outline will not be described in detail since they are conventional and their structure will be readily apparent to a person skilled in the art.

Frame 20 is of open generally rectangular shape and is formed by folding the sheet metal blank shown in FIG. 2 about three transverse fold lines spaced longitudinally of the blank. The blank is generally denoted 30 and includes a longitudinally extending central web portion 32 of planar form, side edge portions 34 and 36 and first and second end portions 38 and 40 respectively. The side edge portions 34 and 36 are longitudinally bent so as to define respective marginal regions 42 and 44 of double blank thickness and respective longitudinally extending parallel flanges 46 and 48. The side edge portions are formed by inwardly folding the sides of a metal sheet from which the blank is formed by 180° at fold lines 50 and 52, thereby imparting the said double blank thickness to the marginal regions 42 and 44. The sheet is then folded upwardly to form the flanges 46 and 48. Flanges 46 and 48 extend parallel to one another inwardly of the marginal regions 42 and 44 and are disposed generally perpendicular to and at the same side of the planar web portion 32. The flanges are divided into sections by V-shaped notches 54 which extend over the entire height of the flange and which are intended to define corners of the completed frame. Thus, the sections between the notches are aligned with one another transversely of the blank and the notches in effect define the transverse lines about which the blank is to be folded; the fold lines are shown in ghost outline at 56.

The first end portion 38 of the blank includes two tabs 58 and 60 which extend beyond an outer edge 62 of the web portion 32 and which are shaped to define therebetween an open T-shaped slot 64. Slot 64 has a stem portion 66 and a transverse portion 68 which defines part of the outer edge 62 of web portion 32.

At the opposite end of the blank, the second portion 40 includes a central tab 70 shaped to fit through and fold over the transverse portion 68 of the T-shaped slot 64 in the first end when the blank is folded, and two outer tabs 72 and 74 adapted to be folded over the outer edge of the web portion at this time. Thus, when the blank is folded into its rectangular form about the fold line 56, tab 70 is inserted through the transverse portion 68 of slot 64 and the tabs 72 and 74 are folded over edge 62 outwardly of the tabs 58 and 60. All five tabs (58, 60, 70, 72 and 74) are then folded down flat against the underside of the portion 32.

FIG. 1 shows the completed frame with the tabs folded down in this fashion. Tabs 58 and 60 and part of tab 74 are visible at the bottom left hand corner of the frame. It will be appreciated that this particular tab configuration has the advantage that the frame is securely held in its folded form and cannot come apart at the joint. Practical tests have shown that, under even the most stringent fire testing procedures, in which the frame is subjected to extremes of temperature and extreme temperature differentials which cause severe twisting stresses in the frame, the integrity of the corner joint is maintained. At the same time, the interlocking tabs which form the joints have been specifically designed for ease of manufacture. In particular, the T-shaped slot 64 can be readily formed by die stamping using a robust T-shaped die. In comparison with the prior art in which slender, fragile dies must be used to form narrow slots, the T-shaped die has been found to be much less prone to breakage and to retain its cutting edge for extended periods of time.

FIG. 3 shows a blank which is essentially very similar to the blank shown in FIG. 2; accordingly, primed reference numerals have been used in FIG. 3 to denote parts which correspond with FIG. 2. The primary difference between the two blanks is that they are made by different manufacturing techniques. By a carful comparison of the two figures, it will be seen that, in FIG. 2, the outermost tabs 72 and 74 at the second end portion of the blank are of single blank thickness and that the flanges 46 and 48 and the double thickness marginal portions 50 and 52 of the blank terminate short of the tabs (at both ends of the blank). In FIG. 3 on the other hand, the tabs 72' and 74' are formed by continuations of the double thickness marginal portions 50' and 52' and are accordingly also of double blank thickness. The first end portions of the blanks are identical. The blank in FIG. 2 has been manufactured by die cutting sheet metal stock to a predetermined shape including all of the tabs and the notches 54, and then roll forming the resulting work piece to the form shown in FIG. 2. The blank 30' of FIG. 3, on the other hand, was made by roll forming sheet metal stock into random lengths of the same profile as the blank shown in FIG. 3; that is, having the double thickness marginal portions 50' and 52' and the upstanding flanges 46' and 48'. The roll formed sections are then cut to length and at the same time the tabs 58', 60' and 70', 72' and 74' as well as the notches 54' are formed by die cutting. The blanks of FIGS. 2 and 3 are equally functional and the particular manufacturing technique adopted will depend on factors such as availability of equipment. For example, it may be that, in some circumstances, it would be considered preferable to make the blank as discussed in connection with FIG. 2 because this technique avoids the necessity for die cutting double blank thicknesses.

FIG. 4 shows a blank according to a further embodiment of the invention which has been designed primarily for manufacturing large size damper frames (e.g. of a width of five feet or more). However, it is to be understood that this form of blank may also be used for smaller frames and that, conversely, blanks of the forms shown in FIGS. 2 and 3 could be used for larger frames. The blank shown in FIG. 4 is substantially similar to the blank of FIGS. 2 and 3 and double primed reference numerals have been used to denote like parts. However, in contrast to FIGS. 2 and 3, the blank of FIG. 4 has no projecting tab at its ends. The end portions of the blank, denoted 38'' and 40'', have straight edges 76 and 78 respectively. Also, the double thickness marginal portions 50'' and 52'' of the blank of FIG. 4 are formed with prepunched holes generally indicated at 80. It will be seen that each marginal portion has two holes adjacent its ends and two pairs of holes arranged on respectively opposite sides of the notch 54'' at the centre of its length. These holes are precisely sized and positioned to co-operate with corresponding holes in end and corner brackets which will be described later in connection with FIG. 7.

Before referring to those figures, it will be convenient to more specifically discuss the form of the notches (54, 54' and 54'') in the flanges of the blank. As shown in FIGS. 2 and 3, each of the notches 54 and 54' defines an enclosed angle of less than 90°. When the blank is folded, the flange sections adjacent each notch are laterally distorted so as to cause the said portions to overlap and provide for frictional engagement between the portions in the assembled frame. FIG. 5 is an enlarged detail view of one of the corners of the frame of FIG. 1. Two adjacent flange sections are indicated at **48*a* and 48*b* and overlapping portions of those sections are denoted $48a_1$ and $48b_1$. The edges of the flange sections defining the relevant notch 54 are denoted 54*a* and 54*b***.

It will be appreciated that the portions $48a_1$ and $48b_1$ will have a natural tendency to assume a configuration in which they are disposed in co-planar relationship with the remainder of the respective flange sections and that, accordingly, the overlapping portions will be urged toward one another and in frictional engagement. This frictional engagement will of course occur at all three corners of the frame defined by the notches 54 and 54' and will have the effect of tending to cause the frame to remain in its rectangular form; that is, to resist distortion of the frame.

Flange portions $48a_1$ and $48b_1$ can be readily brought into their overlapping relationship by appropriately manipulating the blank during folding thereof. For example, the flanges can be laterally deflected by finger pressure or by using a tool such as a screw driver to permit the opposed portions of the flanges to slide past one another. However, it has been found that, in most cases, it is sufficient if the blank is held adjacent its ends during folding and is twisted slightly about its longitudinal axis to an extent sufficient to allow the flange portions to overlap.

In contrast, the notches 54'' of the blank shown in FIG. 4 each define an enclosed angle of 90° and are symmetrical about a line normal to the planar web portion 32'' of the blank. As a consequence, the opposed edges defining each notch are brought into substantially exact abutting relationship when the blank is in its folded condition. One corner of the blank is shown in this form in FIG. 7 and the abutting edges of the relevant notch are indicated by the dotted line denoted 82. Again, this form of corner joint will occur at all three corners of the frame defined by the notches 54''. At least one of those corners will then be provided with a corner bracket such as that indicated at 84 in FIG. 7. The form of this bracket will be more specifically described later. At this stage it should, however, be noted that the 90° notch and corner bracket arrangement may alternatively be used for the form of blank shown in FIGS. 2 and 3 and that, conversely, the smaller notch arrangement of FIG. 5 may be used in association with the form of blank shown in FIG. 4.

Referring back to FIG. 4, the opposed ends of the blank are secured together using an end bracket of the form shown in FIG. 6. The bracket is denoted 86 and is shown in isolation in the view denoted (a) and fitted to abutting end portions of the blank 30'' in view (b). Thus, it will be seen that the end portions 38'' and 40'' of the blank are brought into abutting relationship and that the bracket 86 is disposed externally on the end portions. Bracket 86 is formed with prepunched holes 88 which align with the holes 80 in the marginal portions 50'' and 52'' of the blank. Rivets 90 are set in the aligned holes and secure the end bracket to the blank. The holes in both the end bracket and the blank are carefully positioned so that the end bracket has what is in effect a self aligning effect ensuring accurate formation of the frame.

Referring back to FIG. 7, corner bracket 84 includes a gusset 92 of right triangular shape and two flanges 94 and 96 which project laterally from edges of the gusset adjacent its right angle and at the same side of the gusset, normally thereto. The corner bracket is disposed internally of the frame at a corner remote from the end bracket 86. Corner brackets could of course be provided at each corner remote from the end bracket but this is thought to be unneccessary because a single bracket will ordinarily be sufficient to maintain the rigidity and the right angular form of the frame. In any event, it will be seen that the flanges 94 and 96 of the corner bracket overlie portions of the double thickness marginal region 52' of the blank. The bracket is formed with prepunched holes 98 which align with the holes 80 adjacent the centre notch 54 in each flange (see FIG. 4). The aligned holes receive rivets which secure the corner bracket to the blank. Again, the holes are precision sized and positioned so as to exert a self-aligning effect on the bracket and the blank. Of course, nuts and bolts or other fastening means could be used for both the end bracket 86 and the corner bracket 84.

It will of course be appreciated that the preceeding description relates to a specific embodiment of the invention and the many modifications are possible. In particular, it is to be understood that although specific refenrences have been made herein to fire damper frames, frames constructed according to the invention may equally well be used for other forms of damper such as air control dampers, back draft dampers and louver-(shutter)like devices.

I claim:

1. A one piece frame for fire dampers and the like, the frame being of centrally open, generally rectangular shape formed from a folded elongated sheet metal blank which, in its unfolded form, comprises:

(a) a longitudinally extending central web portion of planar form (b) side edge portions which are longitudinally bent so as to define:

(i) a pair of longitudinally extending marginal regions of double blank thickness for permitting mounting of the frame in an air duct or the like and;

(ii) a pair of longitudinally extending parallel flanges disposed inwardly of said marginal regions and extending perpendicular to and disposed at the same side of the planar web portion, said flanges being divided into sections by V-shaped notches which extend over the entire height of the flange and which are intended to define corners of the completed frame, each section being aligned with sections of the other flange transversely of the blank and extending along a side of the completed frame;

(c) a first end portion including two tabs which extend beyond an outer edge of said web portion and which are shaped to define therebetween an open T-shaped slot having a stem portion and a transverse portion, said transverse portion defining part of said outer edge;

(d) a second end portion including a central tab shaped to fit through and fold over the transverse portion of the T-shaped slot when the frame is in its folded form and adapted to be folded over to retain the frame in said form, and outer tabs adapted to be folded over said outer edge of the web when the frame is in its folded form;

said blank being folded transversely at the positions of said notches with the flanges extending inwardly in forming the frame.

2. A frame as claimed in claim 1, wherein said V-shaped notches define an enclosed angle of 90° and are symmetrical about a line normal to said planar web portion whereby portions of said flanges on opposite sides of said slots are disposed in abutting relationship when the blank is in its folded form.

3. A frame as claimed in claim 1, wherein said V-shaped notches define enclosed angle of less than 90° and portions of said flange sections adjacent each notch are laterally distorted with respect to the remainder of said sections in folding said blank so as to cause said portions to overlap and provide for frictional engagement of said portions when the frame is in its folded form.

4. A frame as claimed in claim 1, wherein said marginal regions of double blank thickness and said flanges terminate short of said tabs at the second end portion of the blank, and wherein the blank is formed by die cutting sheet metal stock to a predetermined shape and roll forming the resulting work piece to form said folded elongated sheet metal blank.

5. A frame as claimed in claim 1, wherein each of said outer tabs is at least partly of double blank thickness and is formed by a continuation of the relevant one of said marginal regions of the blank, and wherein the blank is formed by roll forming sheet metal stock into random lengths each having said marginal regions of double blank thickness and flanges, and die cutting sand random lengths into sections of predetermined length while simultaneously forming said first and second end portions and said V-shaped notches.

6. A one piece frame for fire dampers and the like, the frame being of centrally open, generally rectangular shape, and comprising:

(1) a folded elongate sheet metal blank which, in its unfolded form, comprises:

(a) a longitudinally extending central web portion of planar form (b) side edge portions which are longitudinally bent so as to define:

(i) a pair of longitudinally extending marginal regions of double blank thickness for permitting mounting of the frame in an air duct or the like and;

(ii) a pair of longitudinally extending parallel flanges disposed inwardly of said marginal regions and extending perpendicular to and disposed at the same side of the planar web, said flanges being divided into sections by V-shaped notches which extend over the entire height of the flange and which are intended to define corners of the completed frame, each section being aligned with the sections of the other flange transversely of the blank and extending along a side of the completed frame;

(c) end portions having straight edges perpendicular to said parallel flanges; the blank being folded transversely at the positions of said notches with the flanges extending inwardly and said end portions in abutting relationship;

(2) an end bracket of angle shape in cross-section joining said abutting end portions of the blank, said bracket being disposed externally on said end portions, and said bracket and said blank including aligned holes receiving fastening means firmly securing said bracket to the blank, and;

(3) at least one corner bracket including a gusset of right triangular shape and two flanges which project laterally from edges of the gusset adjacent its right angle at the same side of said gusset and normally thereto, said corner bracket being disposed internally of the frame at a corner thereof remote from said bracket with said flanges overlying portions of one of said marginal regions of the blank at the relevant corner of the frame, said portions and flanges including aligned holes receiving fastening means firmly securing the corner bracket to the blank.

7. A claim as claimed in claim 6, wherein said V-shaped notches define an enclosed angle of 90° and are symmetrical about a line normal to said planar web portion whereby portions of said flanges on opposite sides of said slot are disposed in abutting relationship when the blank is in its folded form.

8. A frame as claimed in claim 6, wherein said V-shaped notches define an enclosed angle of less than 90° and portions of said flange sections adjacent each notch are laterally distorted with respect to the remainder of said sections in folding said blank so as to cause said portions to overlap and provide for frictional engagement of said portions when the frame is in its folded form.

* * * * *